United States Patent [19]

Jore

[11] Patent Number: 4,736,658

[45] Date of Patent: Apr. 12, 1988

[54] SCREW HOLDING AND DRIVING DEVICE

[76] Inventor: Matthew B. Jore, 2120 Hummingbird Dr., Missoula, Mont. 59802

[21] Appl. No.: 808,738

[22] Filed: Dec. 13, 1985

[51] Int. Cl.[4] ..... B25B 23/08

[52] U.S. Cl. ..... 81/451

[58] Field of Search ..... 81/451, 452, 177.2, 81/125

[56] References Cited

U.S. PATENT DOCUMENTS

| | | | |
|---|---|---|---|
| 772,912 | 10/1904 | Allam | 81/451 |
| 2,621,688 | 12/1952 | Wales | 81/177.2 |
| 2,758,494 | 8/1956 | Jenkins | 81/125 |
| 3,517,714 | 6/1970 | Desbarats | 81/451 |
| 3,884,282 | 5/1975 | Dobrosielski | 81/451 |

*Primary Examiner*—Frederick R. Schmidt

*Assistant Examiner*—Bradley I. Vaught

*Attorney, Agent, or Firm*—Richard C. Conover

[57] ABSTRACT

An improved screw holding and driving device having a sleeve positioned on a shank of a screwdriver in surrounding relation. The interior diameter of the sleeve being sized to permit slidable rotation of the sleeve with respect to the shank. The sleeve having a ball detent device for cooperating with a groove located on the screwdriver shank to hold the sleeve in a position on the shank where the sleeve does not extend beyond the screwdriver bit. The ball detent device when engaging the groove enables the sleeve to be held in the position where the sleeve will not be used to hold a screw and at the same time permit the sleeve to be freely rotatable on the shank of the screwdriver.

5 Claims, 3 Drawing Sheets

SCREW HOLDING AND DRIVING DEVICE

BACKGROUND OF THE INVENTION

This invention relates to a device for holding screws securely in contact with a driving bit mounted to the shank of a screwdriver during positioning and driving of a screw.

Screw holding and driving devices are well known in the art as shown by U.S. Pat. No. 4,140,161 to Russo; U.S. Pat. No. 772,912 to Allam; U.S. Pat. No. 2,235,235 to Price; U.S. Pat. No. 2,902,071 to Poynte et al; U.S. Pat. No. 3,392,767 to Stillwagon; U.S. Pat. No. 3,707,894 to Stillwagon; and U.S. Pat. No. 3,739,825 to Knox.

The known screw holding and driving devices show various means for holding a screw in position while screwing the screw in to a material. Many of the patents identified above show a sleeve mounted on the shank of the screwdriver which rotates with the shank when the shank is being turned and include various means for holding the screw in the sleeve.

In screw holding and driving devices it is desirable to permit the device to rotate freely on the shank of the screwdriver while the screw is being turned by the screwdriver. This enables the user to hold the sleeve of the device with one hand for guiding the bit of the screwdriver without the necessity of allowing the shank to slip through the fingers of the user when the screwdriver is being used.

It is also desirable to be able to move the sleeve on the shank towards the handle of the screwdriver when the screw holding and driving device is not to be used so as to permit the user to use the screwdriver normally. It is desirable to provide apparatus for holding the sleeve adjacent the handle when the sleeve is not to be used for holding a screw so that the sleeve will not slip towards the bit end of the screwdriver when the screwdriver is being used normally.

It is further desirable to provide apparatus to permit the sleeve to rotate on the shank of the screwdriver when the sleeve is not being used to hold a screw. This again enables a user to hold the sleeve with one hand while the screwdriver is being used normally to guide the bit of the screwdriver in cooperation with the screw head without the necessity of having to allow the sleeve to slip through the fingers of the user.

SUMMARY OF INVENTION

The present invention is an improved device for holding a screw during positioning and driving of the screw. This invention also has the advantage of having a sleeve which is freely rotatable o the shank of the screwdriver when it is being used normally as a screwdriver and the sleeve is not being used to hold the screw and further permits free rotation of the sleeve on the shank when the sleeve is being used to hold the screw during the driving of the screw.

In order to accomplish these advantages, means are provided on the sleeve which, in cooperation with a groove on the shank of the screwdriver, hold the sleeve in a position where the sleeve cannot be used to drive a screw. In a preferred embodiment, a ball detent device is used to engage the groove on the shank adjacent the handle of the screwdriver. With this ball detent device, the sleeve can rotate easily on the shank when the screwdriver is being used normally without using the sleeve to hold a screw. As a result thereof, the user does not have to allow the shank to slip through his fingers when he is driving the screw. The user may grasp the sleeve with one hand for more accurate positioning of the screwdriver bit. With this arrangement the sleeve freely rotates on the shank of the screwdriver within the sleeve.

The device as described in the present application is a much improved device for holding a screw and for allowing the user to grasp the sleeve while turning the shank of the screwdriver to drive a screw when the sleeve is being used to hold a screw as well as when the sleeve is not being used to hold a screw.

BRIEF DESCRIPTION OF THE DRAWINGS

In order that the invention may be clearly understood and readily carried into effect a preferred embodiment will now be described, by way of example only, with reference to the accompanying drawings wherein.

DESCRIPTION OF A PREFERRED EMBODIMENT

Figure 3:
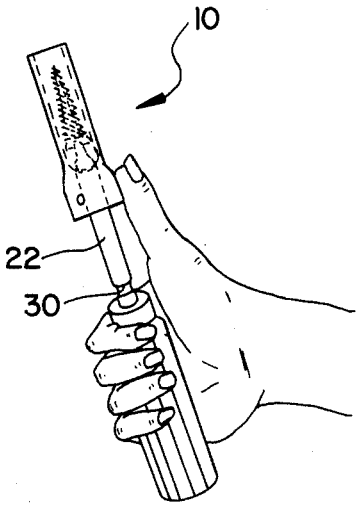
FIG. 3 is a perspective view of the screw holder device in use.
Figure 4:
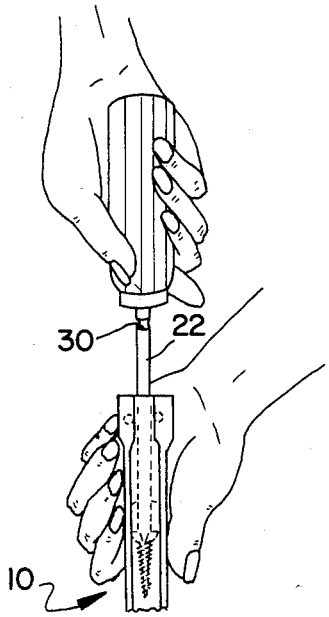
FIG. 4 is another perspective view of the screw holding device in use.

In the drawings, FIGS. 1 through 4 show a screw holder device 10 which includes an outer sleeve 12 having a first end 14 and a second enlarged end 16. The sleeve 12 has a first passage 18 located in the first enlarged end 16 which extends into a second passage 20 having a larger diameter than passage 18. The step junction between the two passages 18 and 20 is designated 19 in the drawings. The passage 18 is sized to slidably but closely fit on the shank 22 of a screwdriver having a handle 24 and a screwdriver bit 26. The passage 20 is sized to accept a head of a screw to be driven with the screwdriver bit 26. When the head of the screw is placed within the passage 20 and engaged with the screwdriver bit 26, the screw is held in a proper position as shown in FIGS. 3 and 4. In a preferred embodiment the shank 22 is magnetized to further secure the bit 26 to the head of a screw. The passage 18 is sized to permit the sleeve 12 to rotate on the shaft 22 of the screwdriver. As shown in FIG. 4, the sleeve can be grasped by the user when driving the screw. This enables the user to accurately position the screw and enables the user to use the device without having to allow the sleeve to slip through the fingers of one hand of the user.

Figure 1:
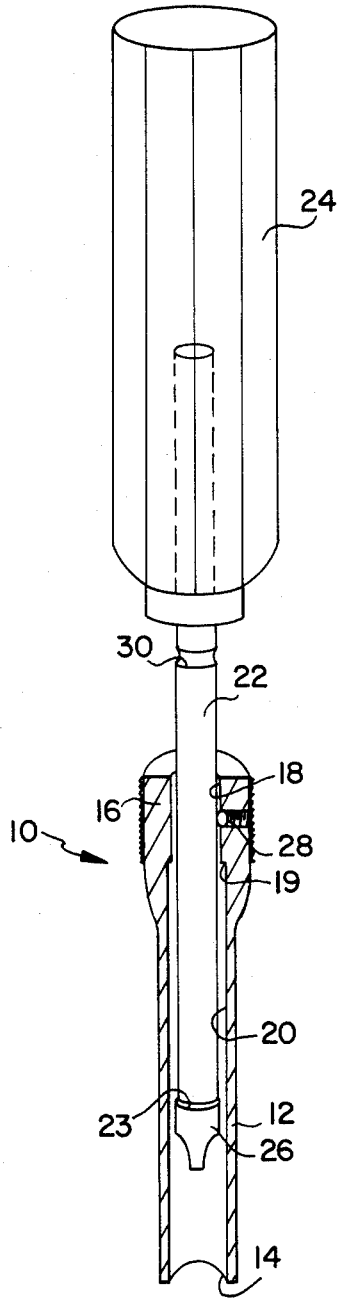
FIG. 1 is an elevational view of a screwdriver with the screw holder device of FIG. 2 shown in cross-section along line A—A shown in FIG. 2.
Figure 2:
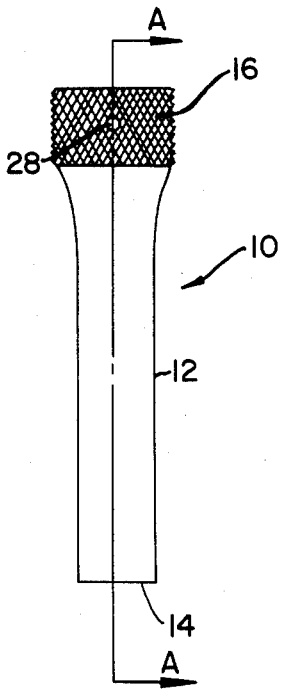
FIG. 2 is a profile view of the screw holder device according to the present invention.

When it is desired to use the screwdriver normally, not using the screw holding sleeve 12 to hold a screw, the sleeve 12 is moved upwardly as shown in FIG. 1 on the shank 22 of the screwdriver so that the screwdriver bit 26 extends beyond the end 14 of sleeve 12. In order to hold the sleeve in this upward position, a conventional ball detent device 28, which is located :n the enlarged portion 16 of sleeve 12, cooperates with a groove 30 formed in the shank 22. The ball detent device in cooperation with the groove 30 holds the sleeve 12 in the upward position. At the same time, the user can grasp the sleeve 12 when driving a screw normally and the sleeve 12 will rotate on the shaft 22 of the screwdriver. This again enables the user to use the screwdriver in a normal manner while at the same time permits the user to firmly guide the shank 22 without the necessity of allowing the shank 22 slip through the user's fingers.

When it is desired to use the sleeve 12 to hold a screw, the user simply forces the sleeve 12 toward the bit 26 of the screwdriver as shown in FIG. 3. The ball of the ball detent device 28 becomes disengaged from the groove 30 and the sleeve is moved towards the bit 26. In a preferred embodiment the junction between the bit 26, having a larger diameter than the shank 22, and shank 22 is a shoulder 23 as shown in FIG. 1 for cooperating with step junction 19 to provide a forward stop means for sleeve 12 when it is moved towards its forwardmost position towards bit 26.

While the fundamental novel features of the invention have been shown and described, it should be understood that various substitutions, modifications and variations may be made by those skilled in the art without departing from the spirit or scope of the invention, including the substitution of other means for the ball detent means to index the sleeve on the shaft 22 of the screwdriver. Accordingly, all such modifications or variations are included in the scope of the invention as defined by the following claims:

I claim:

1. An improved screw holding and driving device for use with a screwdriver having a handle, a shank secured at one end to the handle, the shank having a screw driving bit mounted at a second forward end of the shank comprising:

a one-piece sleeve having an internal diameter sized to slidably rotate on the shank;

the sleeve being adapted to be placed on the shank in surrounding relation to the shank;

the sleeve further being sized to have a length less than the length of the shank;

the sleeve further having a first end portion to be positioned adjacent the screw driving bit and a second end portion, said second end portion being enlarged in size end relation to the first end portion;

a first retaining means, comprising a circumferential groove on the shank, positioned adjacent the rearward end of the shank for operatively cooperating with a second retaining means, comprising a ball detent device, positioned on the sleeve to hold the sleeve in an inoperative position where the sleeve does not surround a portion of the screw;

the second retaining means being positioned within the enlarged portion of the sleeve and being adapted to releasably engage the first retaining means to releasably hold the sleeve in the inoperative position where the screw driving bit extends beyond the end of the sleeve adjacent the screw driving bit;

the first and second retaining means being further adapted to permit free rotation of the sleeve on the shank when the second retaining means engages the first retaining means.

2. The improved screw holding and driving device according to claim 1 further including:

first stop means positioned on the shank for operatively cooperating with a second stop means positioned on the sleeve;

the second stop means in cooperation with the first stop means providing a means for retaining the sleeve on the shank when the sleeve is moved towards its forwardmost position on the shank.

3. The improved screw holding and driving device according to claim 2 wherein the sleeve has an interior first and second connecting passages;

the first passage being located within the second end portion of the sleeve and the second passage being located within the first end portion of the sleeve;

the first passage having an inside diameter sized to slidably but closely fit on the shank and the second passage having an inside diameter larger than that of the first passage and further sized to accept the head of a screw to be driven by the screwdriver.

4. The improved screw holding and driving device according to claim 3 wherein the first stop means includes a shoulder formed when a screw driving bit having a diameter greater than the shank is mounted to the shank and the second stop means includes the step junction formed at the junction between the first passage and the second passage.

5. The improved screw holding and driving device according to claim 1 wherein the driving bit of the screwdriver is magnetized.

* * * * *